United States Patent [19]

Breese et al.

[11] 4,405,907

[45] Sep. 20, 1983

[54] CONTROLLABLE PHASE SHIFTER COMPRISING GYROMAGNETIC AND NON-GYROMAGNETIC SECTIONS

[75] Inventors: Maurice E. Breese, Moorestown, N.J.; Arthur S. Robinson, Reston, Va.

[73] Assignee: RCA Corporation, New York, N.Y.

[21] Appl. No.: 314,848

[22] Filed: Oct. 26, 1981

[51] Int. Cl.[3] ..... H01P 1/195

[52] U.S. Cl. ..... 333/24.1; 333/161; 333/164

[58] Field of Search ..... 333/24.1, 158, 161, 333/164, 102

[56] References Cited

U.S. PATENT DOCUMENTS 3,058,071 10/1962 Walsh et al. ..... 333/24.1 X
3,094,676 6/1963 Bowness ..... 333/102
3,295,138 12/1966 Nelson ..... 333/164 X
3,803,621 4/1974 Britt .
4,070,639 1/1978 Nemit .

OTHER PUBLICATIONS

IEEE Transactions on Microwave Theory and Techniques, Dec. 1975, pp. 1080–1084.
"Tactical Antenna Conceptual Design and Development", Dec. 24, 1979.
Final Technical Report, pp. 8–12 through 8–15.
*Semiconductor Control* by Joseph F. White, Artech House, Inc., 1977, pp. 389–401.

*Primary Examiner*—Paul L. Gensler
*Attorney, Agent, or Firm*—Joseph S. Tripoli; Robert Ochis

[57] ABSTRACT

A phase shifter has two sections, a gyromagnetic section and a switching section connected in series. The gyromagnetic section provides fine increments of phase shift and the switching section provides larger increments of phase shift.

8 Claims, 4 Drawing Figures

Figure 4:
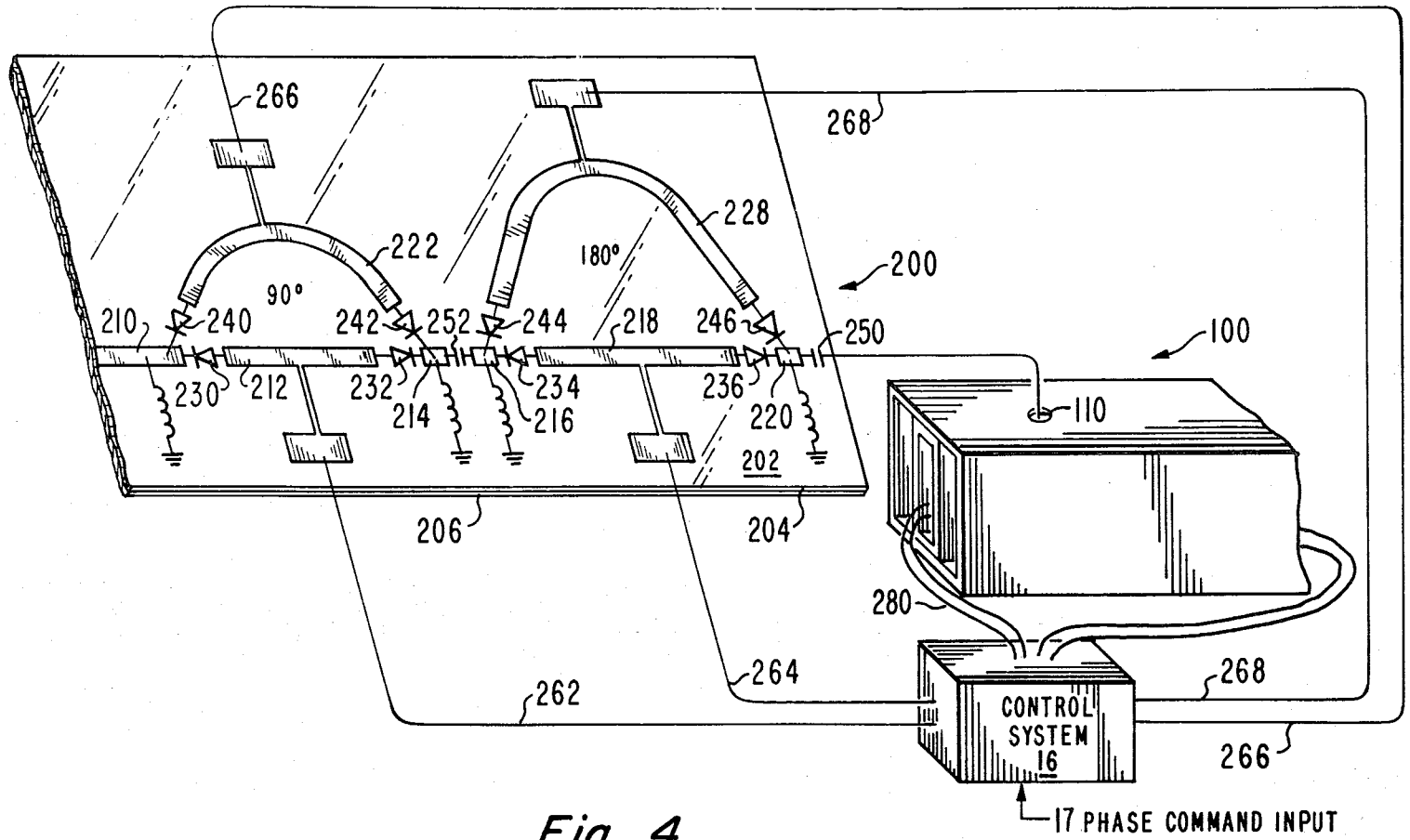

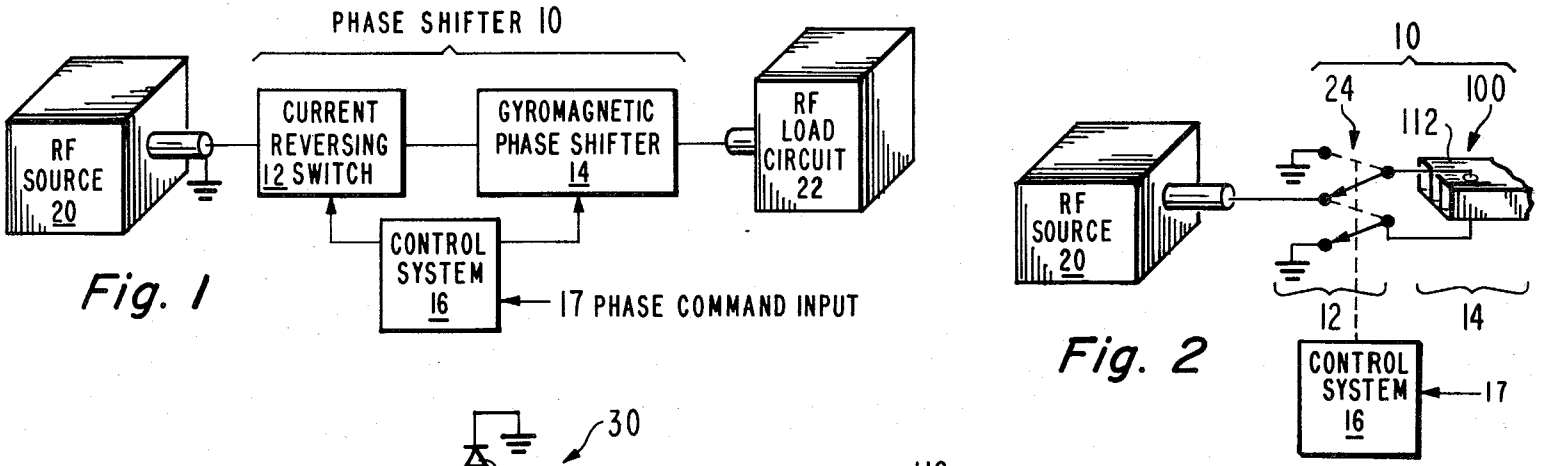
Fig. 1
Fig. 2
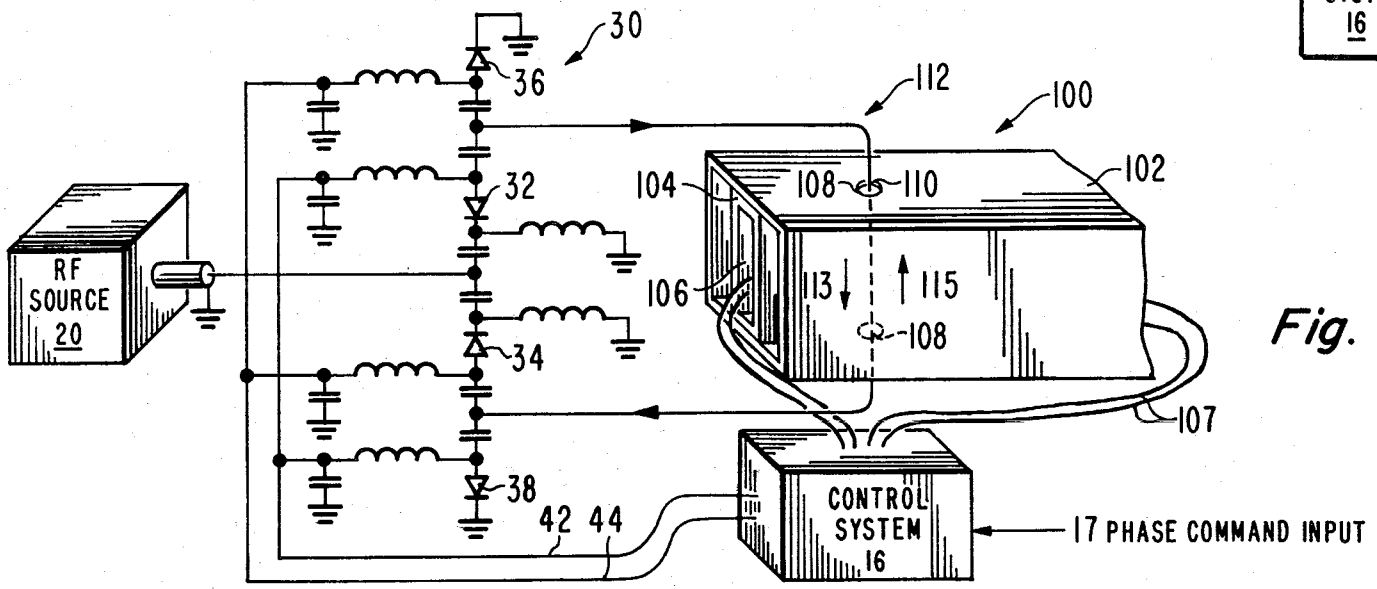
Fig. 3

CONTROLLABLE PHASE SHIFTER COMPRISING GYROMAGNETIC AND NON-GYROMAGNETIC SECTIONS

This invention relates to the field of radio frequency (RF) components and more particularly to RF phase shifters.

A number of phase shifter types are known in the prior art. Gyromagnetic phase shifters are known for their accuracy and, in the case of flux drive gyromagnetic phase shifters, their fine degree of control. Gyromagnetic phase shifters are phase shifters which utilize the magnetic hysteresis properties of a gyromagnetic material to control the phase shift introduced into a propagating wave. Gyromagnetic material is a general term intended to encompass ferrimagnetic materials, ferromagnetic materials and any other materials which exhibit magnetic hysteresis. Ferrites and garnets of the types commonly used in phase shifters are specific classes of gyromagnetic materials. However, gyromagnetic phase shifters are expensive because of the cost of low-loss microwave gyromagnetic materials. Diode phase shifters weigh significantly less than gyromagnetic phase shifters and are known as being inexpensive, but as having a coarse degree of control unless large numbers of diodes are utilized, and as having limited accuracy and higher RF losses. As a consequence, diode phase shifters and gyromagnetic phase shifters have developed as separate arts with each applied to its own particular applications.

RF phase shifters are needed which have the accuracy and the fine degree of control attributed to gyromagnetic phase shifters but at the reduced cost and weight of diode phase shifters.

In accordance with one preferred embodiment of this invention, a phase shifter is provided having the accuracy and fine degree of control of a gyromagnetic phase shifter at substantially reduced cost and weight. This is accomplished by providing a gyromagnetic phase shifter which provides phase shifts up to a first magnitude connected in series with a non-gyromagnetic phase shifter. The non-gyromagnetic phase shifter includes means for reversing the phase of the RF signal.

In the drawing:

FIG. 1 is a block diagram of a phase shifter system in accordance with this invention, FIG. 2 is a schematic illustration of one preferred embodiment of the phase shifter system, FIG. 3 illustrates in more detail the structure of a system such as that in FIG. 2, FIG. 4 illustrates an alternative embodiment of the invention.

In FIG. 1, a phase shifter 10 in accordance with the invention is connected between an RF source 20 and an RF load circuit 22. Source 20 may internally generate RF signals, may modify them or merely transmit them, or may be an antenna which receives RF signals from the ambient environment. The RF load 22 may be a radiating element of an antenna. Phase shifter 10 has two series-connected phase shift sections 12 and 14 which can be in either order. Section 12 is a current reversing switch and section 14 is a gyromagnetic phase shifter. A phase shifter control system 16 receives phase shift commands at its input 17 and provides signals which control the phase shifts introduced by sections 12 and 14.

In FIG. 2, the phase shifter section 12 is illustrated as a current reversing relay switch 24 and phase shifter section 14 is a waveguide gyromagnetic phase shifter 100. Actuating switch 24 reverses the sense of the RF signal current from RF source 20 in the excitation coupling loop 112 in the gyromagnetic waveguide phase shifter 100 and produces a 180° phase shift in the propagated signal which emerges from phase shifter 10.

FIG. 3 illustrates in more detail the gyromagnetic phase shifter and a diode reversing switch 30, suitable for implementing the reversing switch of FIG. 2. The switch 30 comprises four diodes 32, 34, 36 and 38. RF current from source 20 propagating in a clockwise direction in loop 112 (as indicated by the arrow) and downward as indicated by arrow 113 is obtained by forward biasing diodes 32 and 38 and reverse biasing diodes 34 and 36. These diodes 32, 34, 36 and 38 are forward and reverse biased by appropriate DC level voltages from control circuit 16 via leads 42 and 44. A forward bias level on lead 42 and a reverse bias level on lead 44 provide the forward biasing of diodes 32 and 38 and the reverse biasing of diodes 34 and 36. RF signal propagation counterclockwise through loop 112 (in the direction of arrow 115) results from reverse biasing diodes 32 and 38 (reverse bias level on lead 42) and forward biasing diodes 34 and 36 (forward bias level on lead 44). Blocking capacitors restrict the direct current bias signals from the RF coupling loop 112 and RF chokes and bypass capacitors restrict RF signals from control circuit 16.

The gyromagnetic waveguide phase shifter 100 comprises a rectangular waveguide 102, a toroid 104 of gyromagnetic material therein, a dielectric insert 106 in the interior of toroid 104, and a pair of drive wires 107. Toroid 104 may preferably be a low loss microwave garnet material. The loop 112 includes an E-plane 110 that passes through small holes 108 in the waveguide's top and bottom walls. The E-plane probe 110 extends perpendicular to the top and bottom walls and in the plane of the E-field and is preferably mounted in a slot in the gyromagnetic toroid 104 as taught by U.S. patent application Ser. No. 255,282 filed Apr. 17, 1981, now U.S. Pat. No. 4,349,790 entitled "Coax to Rectangular Waveguide Coupler" by Norman R. Landry, which is incorporated herein by reference. Control Circuit 16 provides on leads 107 appropriate DC voltage levels (selected via phase commands at input control 17) to produce appropriate DC magnetic fields in the toroid 104 to control the phase shift through waveguide 102 from 0° to 180°.

Gyromagnetic phase shifters are well known to the art; see for example, U.S. Pat. Nos. 3,555,460; 3,760,305 and 3,768,040.

The phase shifter of FIG. 3 can be very broadband since the 180° phase shift induced by reversing the RF excitation current in the waveguide is not frequency dependent.

FIG. 4 illustrates the phase shifter 10 with an alternative diode phase shifter 200 for phase shifter section 12. In this embodiment, the diode phase shifter provides 180° and 90° increments of phase shift and the gyromagnetic phase shifter 100 provides increments up to 90°. The phase shifter 200 comprises narrow conductive strips 210, 212, 214, 216, 218, 220, 222 and 228 on one surface 202 of a dielectric substrate 204 with the opposite surface covered with a ground plane conductor 206. Switchable diodes and a blocking capacitor 252 bridge the gaps between these strips. With the diode phase shifter 200 set for 0°, diodes 230, 232, 234 and 236 are all forward biased and diodes 240, 242, 244 and 246 are all reverse biased and the RF signal travels in the straight line path involving conductive strips 210, 212, 214, 216, 218 and 220, the forward biased diodes which interconnect them and capacitor 252.

If it is desired to insert a 180° phase shift, diodes 234 and 236 are reverse biased and diodes 244 and 246 are forward biased causing the RF signal to follow longer conductive strip 228 (longer by 180° additional phase delay) rather than conductive strip 218 to provide the 180° additional phase shift. Similarly, to insert a 90° phase shift, diodes 230 and 232 are reverse biased and diodes 240 and 242 are forward biased causing the RF signal to follow the longer conductive strip 222 (longer by 90° additional phase delay) rather than conductive strip 212. The theory of operation of such switched line diode phase shifters is described in greater detail in the book *Semiconductor Control* by Joseph F. White, which is published by Artech House, Inc., at pages 391–401. This material is incorporated herein by reference. Appropriate DC blocking capacitors and RF chokes and RF bypass capacitors are provided.

In response to phase commands received at input 17, control circuit 16 provides DC control signals to phase shifter 200 on lines 262, 264, 266 and 268 which control the bias on diodes 230, 232; 234, 236; 240, 242; and 244, 246 in pairs, respectively. Phase shifter 200 provides 0° phase shift in response to forward bias voltage levels on lines 262 and 264 with reverse bias levels on lines 266 and 268; 90° phase shift in response to forward bias on lines 264 and 266 with reverse bias on lines 262 and 268; 180° phase shift in response to forward bias on lines 262 and 268 with reverse bias on lines 264 and 266, and 270° phase shift in response to forward bias on lines 266 and 268 with reverse bias on lines 262 and 264. These control circuit 16 voltages can be selected manually or in the case of a large phased array system are selected by inputs from a beam steering control subsystem.

The RF output from diode phase shifter 200 is applied from strip 220 via coupling capacitor 250 to an E-plane coupling probe 110 in a typical gyromagnetic waveguide phase shifter 100 like that described previously in connection with FIG. 3. The coupling probe preferably terminates in the waveguide rather than extending all the way through the waveguide as in FIG. 3 since a switchable current loop is not needed here. The toroid length is about half that in FIG. 3 since only a maximum phase shift of 90° (rather than 180° ) need be provided by the gyromagnetic phase shifter since phase shifter 200 up to 270° of phase shift.

The control system 16 again in response to received phase commands selectively provides DC control signals to gyromagnetic phase shifter 100 via leads 280. These DC signals are within a range of values such that they result in DC magnetic fields in the toroid 104 to produce the selected phase shift in the range from 0° to 90°. Control system 16 receives a phase shift command and derives appropriate control signals for the two phase shifters 100 and 200 which establish the overall phase shift of phase shifter 10 at the commanded value.

What is claimed is:

1. A phase shifter for controllably shifting the phase of RF signals by selected amounts comprising:

first and second transmission line sections connected in series;

said first section including gyromagnetic material and means for controlling the magnetic field in said gyromagnetic material to provide a controllable phase shift; and said second section being non-gyromagnetic and including controllable switching means for reversing the sense of the RF current and hence the phase of RF signals propagating along said second section;

said phase shifter designed for said first and second sections to each make a variable contribution to the overall phase shift, that contribution being dependent on the selected overall phase shift.

2. The phase shifter recited in claim 1 wherein said switching means includes a diode switch network.

3. The phase shifter recited in claim 2 wherein said second section comprises switching means for changing the path length followed by the RF signal.

4. The phase shifter recited in claim 1 wherein:

said first section provides increments of phase shift up to 90°; and said second section provides 90° and 180° increments of phase shift.

5. A phase shifter for controllably shifting the phase of RF signals by selected amounts comprising, in combination:

a first phase shifting section including a first transmission line, a body of gyromagnetic material and a controllable source of DC magnetic field for providing a controllable phase shift by controlling the DC magnetic field across said body of gyromagnetic material; and a second phase shifting section including non-gyromagnetic RF coupling means in series with said first phase shifting section, said RF coupling means including switching means for selectively altering the phase of said RF signal propagating through said RF coupling means;

said phase shifter designed for said first and second sections to each make a variable contribution to the overall phase shift, that contribution being dependent on the selected overall phase shift.

6. The combination of claim 5 wherein said switching means includes diode switches.

7. The combination of claim 5 wherein said RF coupling means includes switching means for changing the path length of the RF signal.

8. A phase shifter for controllably shifting the phase of RF signals by selected amounts comprising, in combination:

a first phase shifting section including a first transmission line, a body of gyromagnetic material and DC magnetic field biasing means providing DC magnetic field bias across said body and consequently phase shift dependent upon the level of a first control signal;

a second phase shifting section including non-gyromagnetic RF coupling means connected in series with said first phase shifting section and including alternate signal paths which produce alternate phase shifts and switch means responsive to a second control signal for controlling the signal path and hence the phase shift of the RF signal through said RF coupling means; and means for providing said first and second control signals to said first phase shifting section and said switch means, respectively, said first and second control signals each being dependent on the selected amount of overall phase shift.

* * * * *

UNITED STATES PATENT AND TRADEMARK OFFICE
CERTIFICATE OF CORRECTION

PATENT NO. : 4,405,907

DATED : September 20, 1983

INVENTOR(S) : Maurice E. Breese, et al

It is certified that error appears in the above-identified patent and that said Letters Patent is hereby corrected as shown below:

Column 2, line 36, "E-plane 110" should be --
E-plane probe 110--

Signed and Sealed this

*Twentieth* Day of *March 1984*

[SEAL]

*Attest:*

GERALD J. MOSSINGHOFF

*Attesting Officer*

*Commissioner of Patents and Trademarks*